US008215296B1

(12) United States Patent
Cisneros

(10) Patent No.: US 8,215,296 B1
(45) Date of Patent: Jul. 10, 2012

(54) TILE CUTTING TABLE DEVICE

(76) Inventor: Jorge R Cisneros, Temecula, CA (US)

( * ) Notice: Subject to any disclaimer, the term of this patent is extended or adjusted under 35 U.S.C. 154(b) by 352 days.

(21) Appl. No.: 12/703,381

(22) Filed: Feb. 10, 2010

(51) Int. Cl.
*B28D 7/04* (2006.01)

(52) U.S. Cl. ..... 125/35; 125/13.01; 125/13.03; 451/365; 451/386; 451/391; 269/136; 269/138; 144/286.5; 108/28; 83/452

(58) Field of Classification Search ..... 125/13.01, 125/13.03, 35; 451/365, 386, 391, 368, 41; 83/452–466; 144/286.5, 253.1; 248/500, 248/505; 108/28, 29, 24; 269/289 R, 138, 269/136, 55, 71, 329
See application file for complete search history.

(56) References Cited

U.S. PATENT DOCUMENTS

| | | | | | |
|---|---|---|---|---|---|
| 371,198 | A | * | 10/1887 | Jones | 69/19 |
| 1,333,208 | A | * | 3/1920 | Maguire | 414/9 |
| 1,552,532 | A | * | 9/1925 | Zucker | 269/238 |
| 1,728,718 | A | * | 9/1929 | Bell | 269/95 |
| 1,735,178 | A | * | 11/1929 | Pittman | 83/488 |
| 1,973,204 | A | * | 9/1934 | Goss et al. | 408/10 |
| 2,399,239 | A | * | 4/1946 | Martin | 451/213 |
| 2,493,846 | A | * | 1/1950 | Andrews | 108/28 |
| 2,591,206 | A | * | 4/1952 | Scott | 125/13.01 |
| 2,951,517 | A | * | 9/1960 | Webb et al. | 144/250.18 |
| 3,311,103 | A | * | 3/1967 | Simpson | 125/13.03 |
| 4,221,368 | A | * | 9/1980 | Channel | 269/54.3 |
| 4,564,179 | A | * | 1/1986 | Hollingsworth | 269/71 |
| 4,653,371 | A | | 3/1987 | Vancalbergh | |
| 4,674,381 | A | | 6/1987 | Cadorin | |
| 4,779,603 | A | * | 10/1988 | Crocetti | 125/13.01 |
| 4,896,647 | A | * | 1/1990 | Valva et al. | 125/14 |
| 5,103,704 | A | | 4/1992 | Spath et al. | |
| 5,425,405 | A | * | 6/1995 | Brodsky, Sr. | 144/253.2 |
| 5,544,997 | A | * | 8/1996 | Raynor | 414/412 |
| 5,584,254 | A | * | 12/1996 | Williams | 108/118 |
| 5,953,975 | A | * | 9/1999 | Kreitzberg | 83/397 |
| 6,142,199 | A | * | 11/2000 | Schibline | 144/363 |
| 6,148,881 | A | * | 11/2000 | Valenzuela | 144/286.1 |
| 6,203,255 | B1 | * | 3/2001 | Broussard | 409/226 |
| D442,977 | S | | 5/2001 | Howard | |
| 6,557,602 | B1 | * | 5/2003 | Sorensen et al. | 144/286.5 |
| 7,040,362 | B1 | * | 5/2006 | Monuik et al. | 144/193.2 |
| 7,044,178 | B1 | * | 5/2006 | Campbell | 144/285 |
| 7,182,080 | B1 | | 2/2007 | O'Neal | |
| 7,628,186 | B2 | * | 12/2009 | Blum | 144/286.1 |
| 8,066,042 | B2 | * | 11/2011 | Carter | 144/286.1 |
| 2005/0098166 | A1 | | 5/2005 | Cheng et al. | |
| 2007/0197139 | A1 | | 8/2007 | Wise | |
| 2008/0257328 | A1 | | 10/2008 | Sheddy et al. | |

* cited by examiner

*Primary Examiner* — George Nguyen

(57) ABSTRACT

A tile cutting table device featuring a platform with foldable legs; four side panels pivotally attached to side edges of the platform, the side panels can pivot between a down position and an up position forming an enclosure around the top surface of the platform; a water inlet hole for fluidly connecting a water source to the device; a drainage hole disposed in the platform; a perforated tile cutting plate disposed on the top surface of the platform; a clamp bar positioned over the tile cutting plate, the clamp bar functions to clamp down on a tile to hold the tile in place during cutting procedures, the clamp bar is connected to a foot pedal which functions to move the clamp bar between an up position and a down position, wherein the clamp bar is biased in the up position caused by compression springs.

8 Claims, 5 Drawing Sheets

TILE CUTTING TABLE DEVICE

FIELD OF THE INVENTION

The present invention is directed to a table-like device more particularly to a table comprising features that allow a user to cut tile.

BACKGROUND OF THE INVENTION

Cutting tile often requires heavy equipment, for example a heavy tub saw. The present invention features a novel tile cutting table device. The device of the present invention is lightweight, compact, and easy to transport. The table device 100 may eliminate the need for using a standard/heavier tub saw.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a tile cutting table device comprising a generally flat platform, wherein legs extend downwardly from the platform, the legs are pivotally attached to the platform such that the legs can be folded underneath the platform for storage or transport; a first side panel pivotally attached to a first side edge of the platform, a second side panel pivotally attached to a second side edge of the platform, a third side panel pivotally attached to a third side edge of the platform, and a fourth side panel pivotally attached to a fourth side edge of the platform, wherein the side panels can pivot between a down position wherein the panels lie atop a top surface of the platform and an up position wherein the side panels are generally perpendicular to the platform and together form an enclosure around the top surface of the platform; a water inlet hole disposed in either the platform or a side panel, the water inlet hole functions to fluidly connect a water source to the tile cutting table device such that water can be brought onto the top surface of the platform; and a drainage hole disposed in the platform, the drainage hole functions to drain off water from the top surface of the platform.

The device further comprises a perforated tile cutting plate disposed on the top surface of the platform, the perforated tile cutting plate comprises one or more cutting grooves disposed therein for accommodating a blade of a saw; a clamp bar positioned over the tile cutting plate, the clamp bar functions to clamp down on a tile to hold the tile in place during cutting procedures, wherein a first shaft extends downwardly from a first end of the clamp bar and a second shaft extends downwardly from a second end of the clamp bar, the first shaft extends through and past a first compression spring disposed in the cutting plate, the second shaft extends through and past a second compression spring disposed in the cutting plate, the first shaft and second shaft are both attached to a stabilizing plate positioned underneath the platform, wherein the clamp bar can move between a down position wherein the clamp bar is moved toward the cutting plate and an up position wherein the clamp bar is moved away from the cutting plate, the clamp bar is biased in the up position caused by the compression springs; and a pedal rod extending downwardly from the stabilizing plate and attaching to a foot pedal, the foot pedal can move between a down position wherein the foot pedal is pushed toward a ground surface and an up position wherein the foot pedal is raised above the ground surface, the foot pedal is biased in the up position caused by the compression springs; wherein when the foot pedal is pushed to the down position the pedal rod, stabilizing plate, and first shaft and second shaft pull down on the clamp bar moving the clamp bar to the down position to clamp down on the tile.

In some embodiments, the platform is constructed from a material comprising glass. In some embodiments, the legs are pivotally attached to the platform via leg hinges. In some embodiments, the side panels can be secured in the up position via locks. In some embodiments, the water source is a water hose.

In some embodiments, a drainage tube is fluidly connected to the drainage hole. In some embodiments, the device further comprises a handle disposed on a side edge the platform for providing a user an easy means of carrying the tile cutting table device when the tile cutting table device is in a storage position. In some embodiments, a rubber panel is disposed on a bottom surface of the clamp bar, the rubber panel helps protect the tile from damage by the clamp bar when the clamp bar clamps down on the tile.

DESCRIPTION OF PREFERRED EMBODIMENTS

Referring now to FIGS. 1-5, the present invention features a tile cutting table device 100. An individual such as a flooring contractor may use the table device 100 of the present invention to cut floor tile with a tile saw (a circular saw with a water reservoir). Without wishing to limit the present invention to any theory or mechanism, it is believed that the table device 100 of the present invention is advantageous because it is lightweight and can be easily transported. The table device 100 may eliminate the need for using a standard/heavier tub saw.

The table device 100 of the present invention resembles a standard large table (e.g., a large card table). For example, the table device 100 comprises a platform 110 with four legs 118 extending downwardly from the four corners of the platform 110. The table device 100 may be constructed from a variety of materials and in a variety of sizes. In some embodiments, the platform 110 is constructed from a material comprising glass. In some embodiments, the legs 118 are pivotally attached to the platform 110, for example via leg hinges. The pivot attachment of the legs 118 allows for the legs to be folded underneath the platform 110, achieving a more compact configuration (e.g., a storage position) for storage or transport (see FIG. 4). Mechanisms for folding legs underneath a platform are well known to one of ordinary skill in the art and are not limited to leg hinges.

In some embodiments, the platform 110 is between about 24 to 30 inches in length as measured from the first side edge to the second side edge. In some embodiments, the platform 110 is between about 30 to 36 inches in length as measured from the first side edge to the second side edge. In some embodiments, the platform 110 is between about 36 to 42 inches in length as measured from the first side edge to the second side edge. In some embodiments, the platform 110 is more than about inches 42 in length.

In some embodiments, the platform 110 is between about 24 to 30 inches in width as measured from the third side edge to the fourth side edge. In some embodiments, the platform 110 is between about 30 to 36 inches in width as measured from the third side edge to the fourth side edge. In some embodiments, the platform 110 is between about 36 to 42 inches in width as measured from the third side edge to the fourth side edge. In some embodiments, the platform 110 is more than about 42 inches in width.

Figure 4:
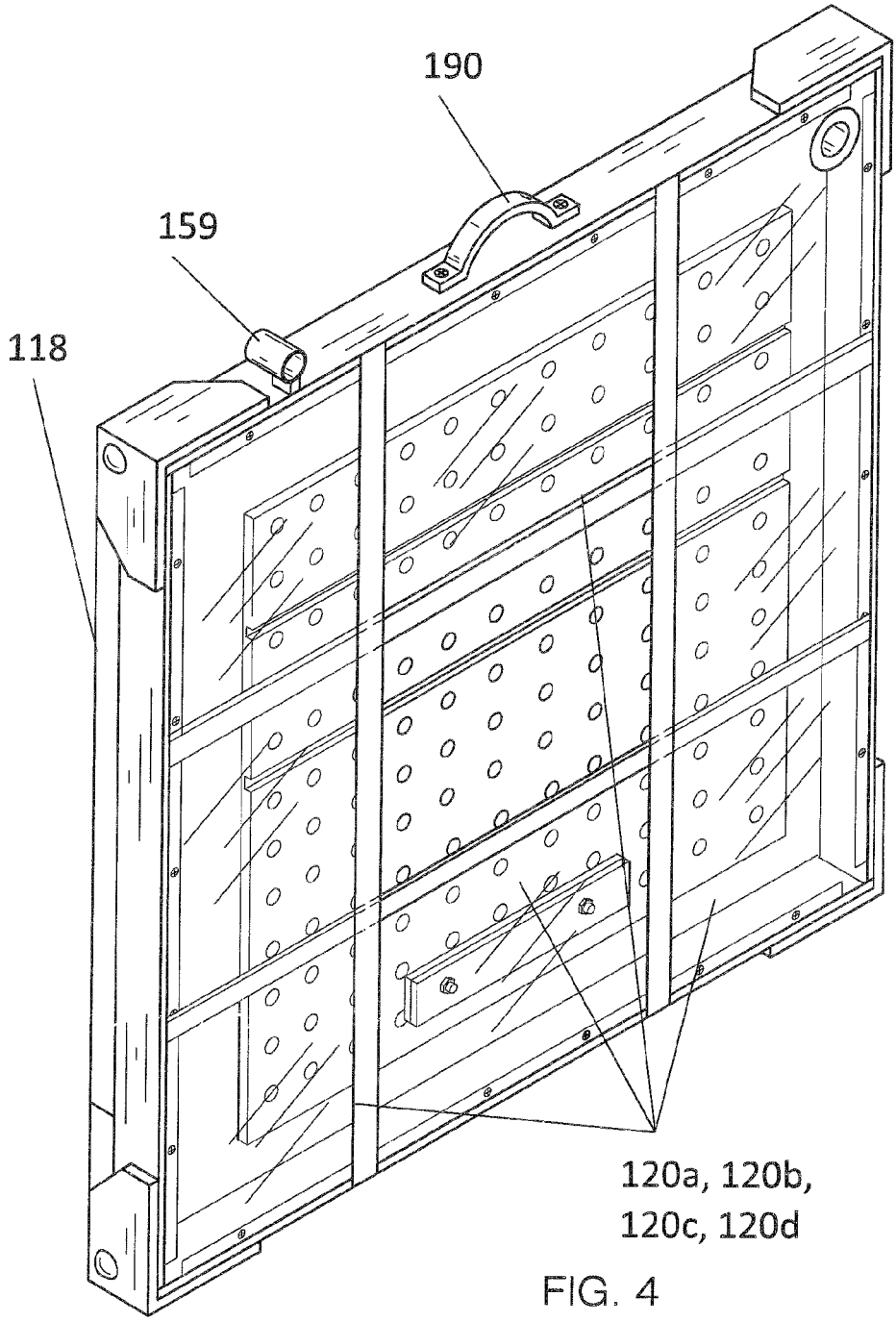
FIG. 4 is a perspective view of the tile cutting table of the present invention as folded in a storage position (e.g., for storage or transport).

Pivotally attached to the first side edge of the platform 110 (e.g., via one or more first hinges) is a first side panel 120*a*. Pivotally attached to the second side edge of the platform 110 (e.g., via one or more second hinges 125*b*) is a second side panel 120*b*. Pivotally attached to the third side edge of the platform 110 (e.g., via one or more third hinges) is a third side panel 120*c*. Pivotally attached to the fourth side edge of the platform 110 (e.g., via one or more fourth hinges 125*d*) is a fourth side panel 120*d*. The side panels 120 can pivot between a down position wherein the panels lie atop the top surface of the platform 110 (see FIG. 4 showing the device 100 in the storage position. The side panels 120 can pivot to an up position, wherein the side panels 120 are pivoted upwardly such that they are generally perpendicular to the platform 110 and form an enclosure on the top surface of the platform 110. When the side panels 120 are in the up position and form an enclosure, the enclosure can allow water to be retained during a cutting operation.

Figure 1:
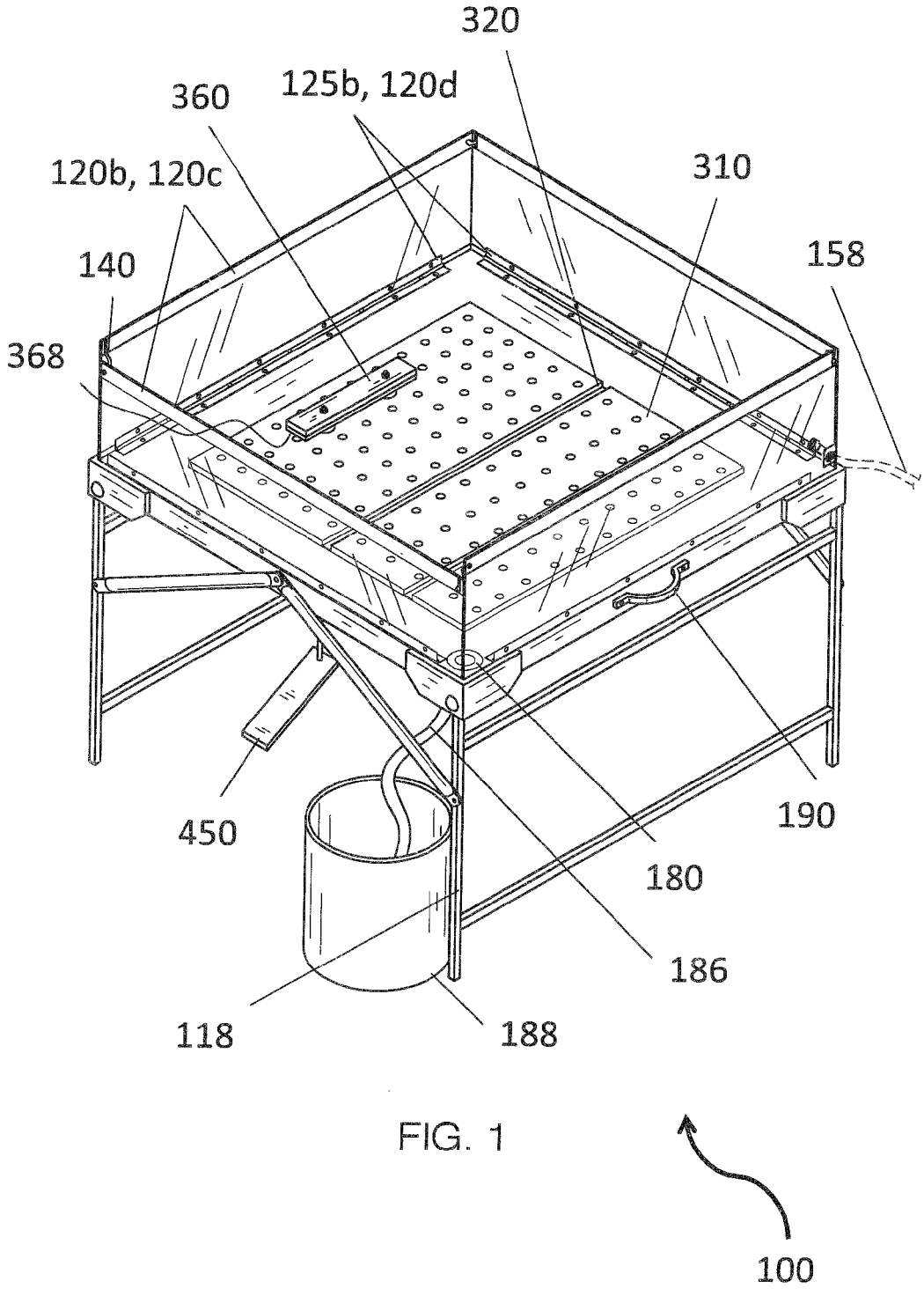
FIG. 1 is a perspective view of the tile cutting table of the present invention.

In some embodiments, the side panels 120 can be secured in the up position via locks. The locks may be disposed on the ends of each side panel 120 and are adapted to engage locks on the ends of the other panels 120. For example, a first lock is disposed on a first end of the first side panel 120*a* and a second lock is disposed on a second end of the third side panel 120*c*. When the first side panel 120*a* and third side panel 120*c* are both in the up position, the first lock and third lock can be locked together, keeping the side panels in the up position. As shown in FIG. 1, a lock 140 is disposed on the first end of the third side panel 120*c*, and the lock 140 engages a lock disposed on the second end of the second side panel 120*b*. In some embodiments, the side panels can be secured in the up position via a brace. The present invention is not limited to locks and braces for keeping the side panels in the up position.

Water is often used when cutting tile (e.g., to cool the blade of the saw). In some embodiments, the tile cutting table device 100 of the present invention comprises a water inlet hole 150. The water inlet hole 150 allows a water hose 158 to be fluidly connected to the device 100 such that water can be brought onto the top surface of the platform 110. In some embodiments, the water inlet hole 150 is disposed in the platform 110, for example at corner (e.g., the intersection of the first side panel 120*a* and the fourth side panel 120*d*). In some embodiments, the water inlet hole 150 is disposed in a side panel 120. In some embodiments, the device 100 further comprises a hose reel for supporting or holding the water hose 158 that brings in the water for the platform 110. In some embodiments, a tube holder 159 is disposed on the device 100, for example on an edge of the platform 110 (see FIG. 4). The tube holder 159 may be used to hold a water hose 158 (or for other purposes).

A drainage hole 180 for draining off water from the platform 110 is disposed in the panel 110, for example in a corner of the panel 110. As shown in FIG. 1, the drainage hole 180 is disposed near the intersection of the first side panel 120*a* and the third side panel 120*c*. Fluidly connected to the drainage hole 180 is a drainage tube 186 that drains fluid from the drainage hole 180 into a bucket 188.

In some embodiments, one or more handles 190 are disposed on the device 100, for example on the platform 110. As shown in FIG. 1 and FIG. 4, a handle 190 is disposed on the edge of the platform 110 corresponding to the first side panel 120*a*. The handle 190 may allow for easy carrying of the device 100 when the device 100 is folded to the storage position (see FIG. 4).

Disposed on the top surface of the platform 110 is a cutting plate 310 (e.g., perforated cutting plate 310) for cutting tile. One or more cutting grooves 320 may be disposed in the cutting plate 310. The cutting grooves are adapted to accommodate the blade of a saw (e.g., a wet saw for cutting tile). The cutting grooves 320 may extend from a first side edge to an opposite side edge (e.g., in a straight line). The perforations in the cutting plate 310 may allow water to drain from the cutting plate to the platform 110 (and then be drained out of the drainage hole 180).

Figure 2:
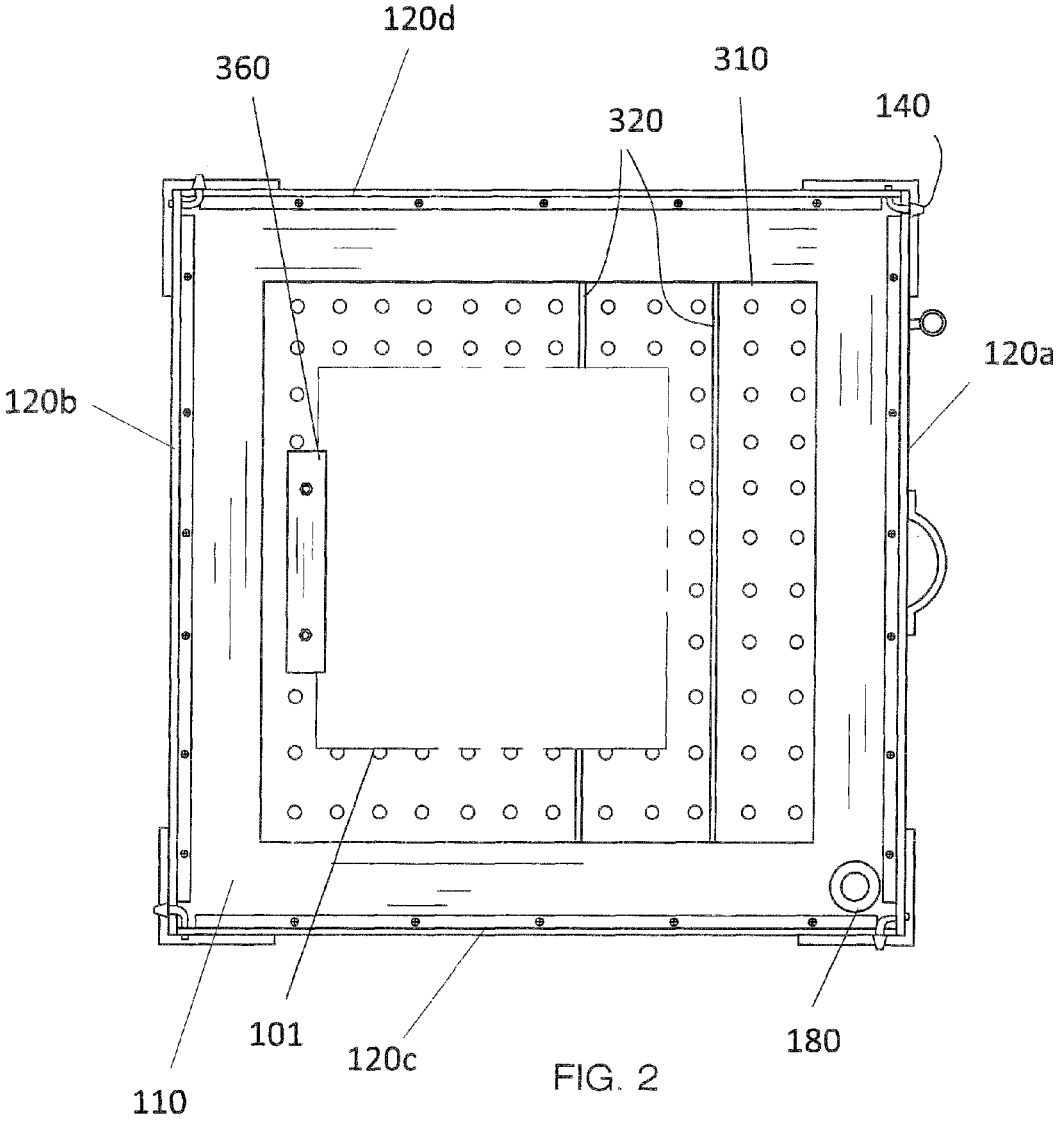
FIG. 2 is a top view of the tile cutting table of FIG. 1.
Figure 3:
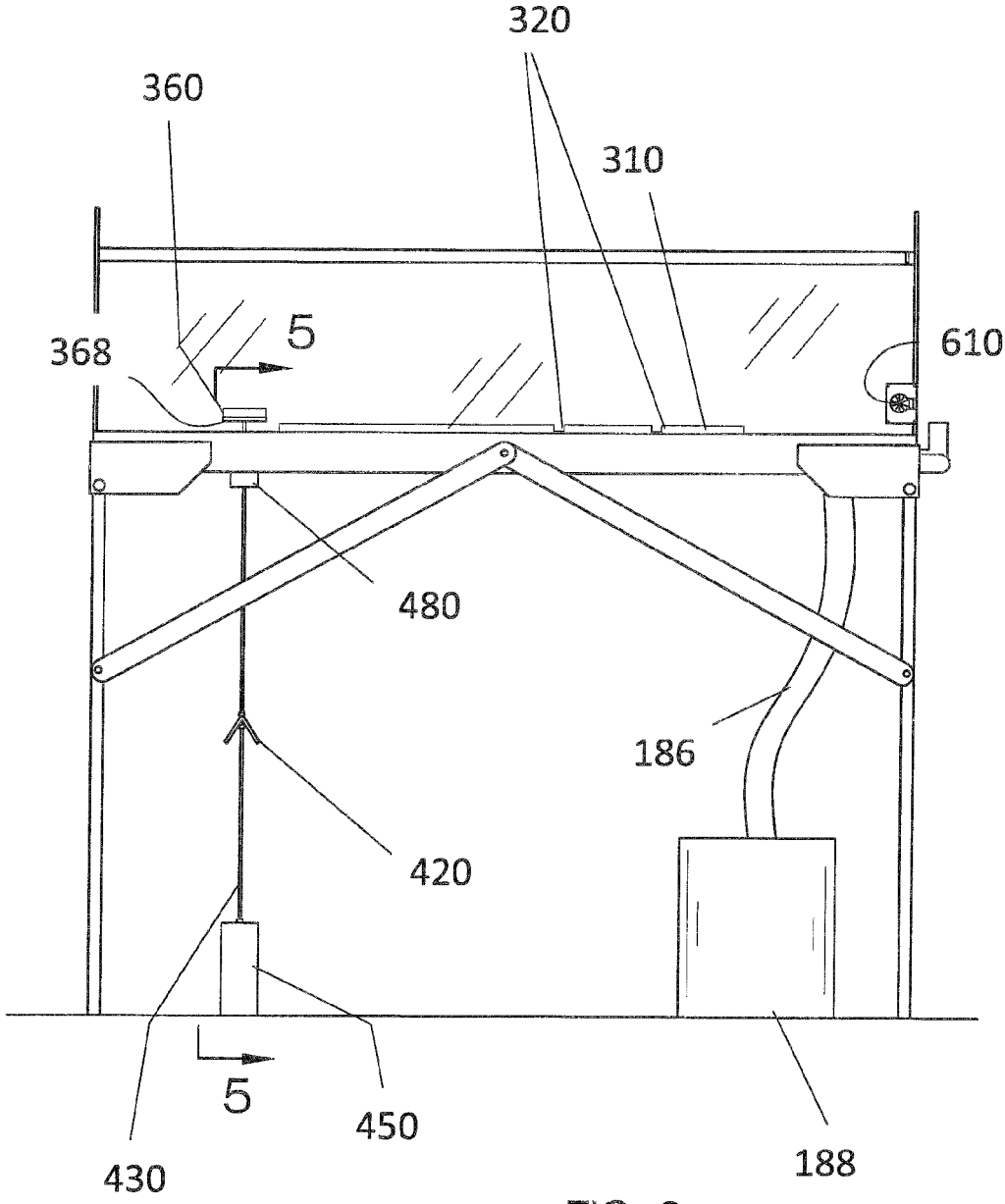
FIG. 3 is a side view of the tile cutting table of FIG. 1.

Disposed on the cutting plate 310, for example at a side edge of the cutting plate 310, is a tile holder apparatus. The tile holder apparatus is a clamp-like device for clamping down on a piece of tile 101. The tile holder apparatus comprises a clamp bar 360 positioned atop the tile cutting plate 310. As shown in FIG. 2, a tile 101 is placed atop the cutting plate 310 and is secured in place via the clamp bar 360 of the tile holder apparatus.

Figure 5:
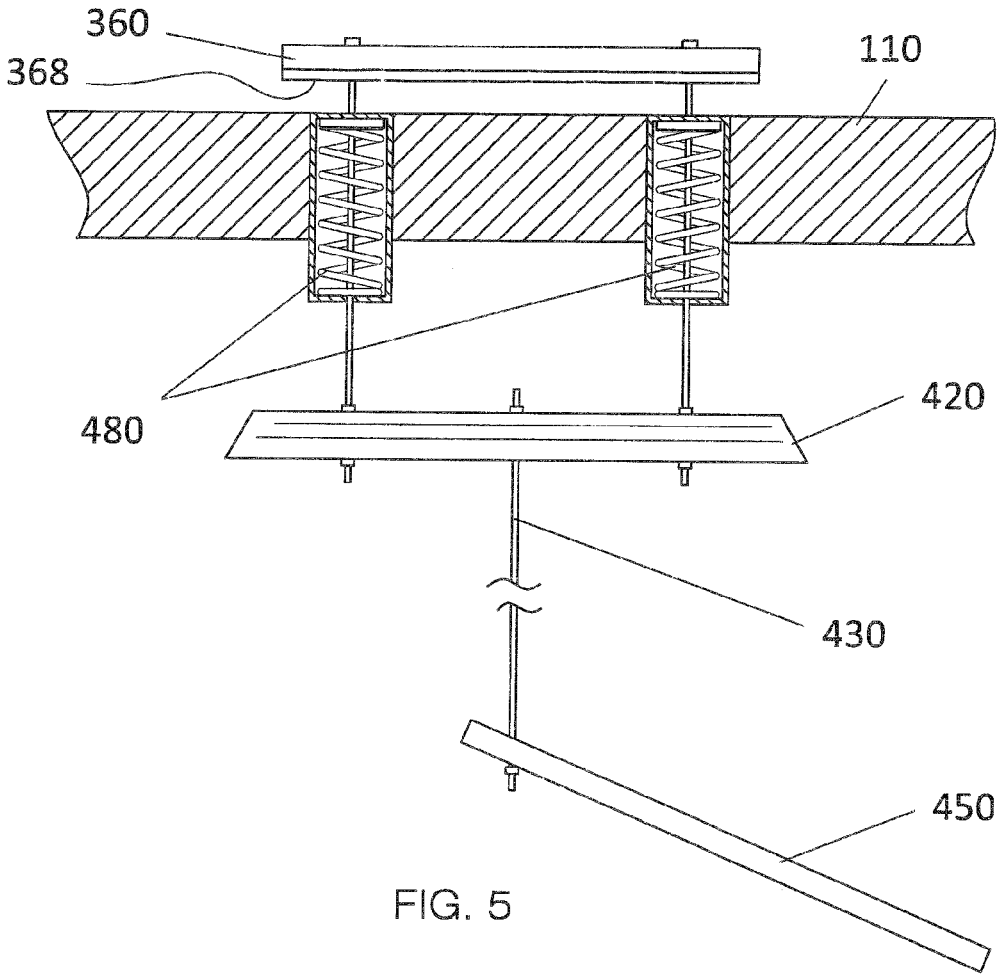
FIG. 5 is a cross sectional view of the tile cutting table of FIG. 3.

As shown in FIG. 5, the clamp bar 360 is positioned above the cutting plate 310. The clamp bar 360 can move between an up position (hovering above the cutting plate 310) and a down position (contacting the cutting plate 310 or tile 101). The clamp bar 360 has a first end, a second end, a top surface, and a bottom surface. In some embodiments, a rubber panel 368 is disposed on the bottom surface of the clamp bar 360 (e.g., being sandwiched between the clamp bar 360 and the cutting plate 310 or tile 101). The rubber panel 368 can help protect the tile 101 from damage by the clamp bar 360 when the clamp bar 360 clamps down on the tile 101.

The clamp bar 360 is attached to the cutting plate 310 via a first shaft extending downwardly through the cutting plate 310 from the first end of the clamp bar 360 and a second shaft extending downwardly through the cutting plate 310. The first shaft extends through a first compression spring 480 disposed in the cutting plate 310 and the second shaft extends through a second compression spring 480 disposed in the cutting plate 310 (see FIG. 5). The clamp bar 360 is biased in the up position caused by the compression springs.

The first shaft and second shaft are attached to a first end and second end of a stabilizing plate 420, respectively. A pedal rod 430 extends downwardly from the stabilizing plate 420 and attaches to a foot pedal 450. To move the clamp bar 360 to the down position, a user can press the foot pedal 450, which pulls down the pedal rod 430. This causes the stabilizing plate 420 to be pulled down, which pulls down on the first and second shafts. This force overcomes the springs and pulls down on the clamp bar 360. In some embodiments, a user can place a tile 101 under the clamp bar 360 and push down on the foot pedal 450 to clamp down on the tile 101

In some embodiments, the device 100 further comprises an electric cable or water line opening 610. The opening 610 may be useful for a power cord or a water line.

As used herein, the term "about" refers to plus or minus 10% of the referenced number. For example, an embodiment wherein the platform 110 is about 30 inches in width includes a platform that is between 27 and 33 inches in width.

The following the disclosures of the following U.S. patents are incorporated in their entirety by reference herein: U.S. Pat. No. 5,103,704; U.S. Pat. Application No. 2005/0098166; U.S. Pat. No. 4,653,371; U.S. Pat. Application No. 2008/0257328; U.S. Pat. Application No. 2007/0197139; U.S. Pat. No. 7,182,080; U.S. Pat. No. 4,674,381.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A tile cutting table device comprising:

(a) a generally flat platform, wherein legs extend downwardly from the platform, the legs are pivotally attached to the platform such that the legs can be folded underneath the platform for storage or transport;

(b) a first side panel pivotally attached to a first side edge of the platform, a second side panel pivotally attached to a second side edge of the platform, a third side panel pivotally attached to a third side edge of the platform, and a fourth side panel pivotally attached to a fourth side edge of the platform, wherein the side panels can pivot between a down position wherein the panels lie atop a top surface of the platform and an up position wherein the side panels are generally perpendicular to the platform and together form an enclosure around the top surface of the platform;

(c) a water inlet hole disposed in either the platform or a side panel, the water inlet hole functions to fluidly connect a water source to the tile cutting table device such that water can be brought onto the top surface of the platform;

(d) a drainage hole disposed in the platform, the drainage hole functions to drain off water from the top surface of the platform;

(e) a perforated tile cutting plate disposed on the top surface of the platform, the perforated tile cutting plate comprises one or more cutting grooves disposed therein for accommodating a blade of a saw;

(f) a clamp bar positioned over the tile cutting plate, the clamp bar functions to clamp down on a tile to hold the tile in place during cutting procedures, wherein a first shaft extends downwardly from a first end of the clamp bar and a second shaft extends downwardly from a second end of the clamp bar, the first shaft extends through and past a first compression spring disposed in the cutting plate, the second shaft extends through and past a second compression spring disposed in the cutting plate, the first shaft and second shaft are both attached to a stabilizing plate positioned underneath the platform, wherein the clamp bar can move between a down position wherein the clamp bar is moved toward the cutting plate and an up position wherein the clamp bar is moved away from the cutting plate, the clamp bar is biased in the up position caused by the compression springs; and (g) a pedal rod extending downwardly from the stabilizing plate and attaching to a foot pedal, the foot pedal can move between a down position wherein the foot pedal is pushed toward a ground surface and an up position wherein the foot pedal is raised above the ground surface, the foot pedal is biased in the up position caused by the compression springs;

wherein when the foot pedal is pushed to the down position the pedal rod, stabilizing plate, and first shaft and second shaft pull down on the clamp bar moving the clamp bar to the down position to clamp down on the tile.

2. The tile cutting table device of claim 1, wherein the platform is constructed from a material comprising glass.

3. The tile cutting table device of claim 1, wherein the legs are pivotally attached to the platform via leg hinges.

4. The tile cutting table device of claim 1, wherein the side panels can be secured in the up position via locks.

5. The tile cutting table device of claim 1, wherein the water source is a water hose.

6. The tile cutting table device of claim 1, wherein a drainage tube is fluidly connected to the drainage hole.

7. The tile cutting table device of claim 1 further comprising a handle disposed on a side edge the platform for providing a user an easy means of carrying the tile cutting table device when the tile cutting table device is in a storage position.

8. The tile cutting table device of claim 1, wherein a rubber panel is disposed on a bottom surface of the clamp bar, the rubber panel helps protect the tile from damage by the clamp bar when the clamp bar clamps down on the tile.

* * * * *